US011439204B2

(12) United States Patent
Dente

(10) Patent No.: US 11,439,204 B2
(45) Date of Patent: Sep. 13, 2022

(54) MID-SOLE TRACTION DEVICE

(71) Applicant: Dentec Safety Specialists Inc., Newmarket (CA)

(72) Inventor: Claudio Dente, Newmarket (CA)

(73) Assignee: Dentec Safety Specialists Inc., Newmarket (CA)

( * ) Notice: Subject to any disclaimer, the term of this patent is extended or adjusted under 35 U.S.C. 154(b) by 0 days.

(21) Appl. No.: 17/230,703

(22) Filed: Apr. 14, 2021

(65) Prior Publication Data

US 2022/0031025 A1 Feb. 3, 2022

(30) Foreign Application Priority Data

Jul. 31, 2020 (CA) ..... CA 3088629

(51) Int. Cl.
*A43C 15/06* (2006.01)
*A43C 15/02* (2006.01)

(52) U.S. Cl.
CPC ..... *A43C 15/065* (2013.01); *A43C 15/02* (2013.01)

(58) Field of Classification Search
CPC ..... A43C 15/02; A43C 15/063; A43C 15/065; A43B 5/18
USPC ..... 36/7.6, 7.7, 62, 64
See application file for complete search history.

(56) References Cited

U.S. PATENT DOCUMENTS 14,527 A * 3/1856 Towers ..... A43C 15/063 36/62
156,094 A * 10/1874 Lemmon ..... A43C 15/063 36/62
183,949 A 10/1876 Loewenthal
313,161 A * 3/1885 Belknap et al. ..... A43C 15/063 36/62

(Continued)

FOREIGN PATENT DOCUMENTS

CA 1112865 A 11/1981
CA 2355803 A1 2/2002

(Continued)

OTHER PUBLICATIONS

"Devisys Anti-Slip Devices", https://www.devisys.fi/language/en/en/ last accessed Apr. 25, 2022, 9 pages.

(Continued)

*Primary Examiner* — Ted Kavanaugh
(74) *Attorney, Agent, or Firm* — Dorsey & Whitney LLP

(57) ABSTRACT

A mid-sole traction device for a shoe or a boot comprises a traction platform formed of a flexible rubber material. The platform has a first face for contacting a ground surface and a second face for attachment to a mid-sole of the shoe/boot. The first face is spaced from the second face. First and second protrusions are formed on the first face. The first protrusion has first and second ends, each of which defines an opening for receiving a spike. The second protrusion has first and second ends, each of which defines an opening for receiving a spike. The second protrusion is separate and spaced from the first protrusion. A first slot is formed in the (Continued)

platform and is located near a first peripheral edge of the platform for receiving a strap. A second slot is formed in the platform near a second peripheral edge for receiving a strap.

20 Claims, 4 Drawing Sheets

(56) References Cited

U.S. PATENT DOCUMENTS

| | | | | | |
|---|---|---|---|---|---|
| 405,381 | A | * | 6/1889 | Steiner | A43C 15/063 36/7.7 |
| 1,117,019 | A | | 11/1914 | Foltz | |
| 1,195,866 | A | | 8/1916 | Stephan | |
| 1,386,028 | A | | 8/1921 | Roe | |
| 1,437,376 | A | | 11/1922 | Young | |
| 1,458,497 | A | | 6/1923 | Perkins | |
| 1,552,946 | A | | 9/1925 | Frederick | |
| 1,564,307 | A | | 12/1925 | Antonio et al. | |
| 1,596,832 | A | | 8/1926 | Heinemann | |
| 1,757,919 | A | | 5/1930 | Ostrander | |
| 1,869,988 | A | | 8/1932 | Stephen | |
| 2,118,113 | A | * | 5/1938 | Schemel | A43C 13/04 36/134 |
| 2,128,134 | A | | 8/1938 | Nicola | |
| 2,166,958 | A | * | 7/1939 | Lawson | A43C 15/063 D2/962 |
| 2,170,691 | A | | 8/1939 | Mutter | |
| 2,189,884 | A | | 2/1940 | Dow | |
| 2,313,316 | A | | 3/1943 | Block | |
| 2,367,736 | A | * | 1/1945 | Parsons | A43C 13/04 D2/962 |
| 2,401,891 | A | * | 6/1946 | Smith | A43C 15/065 36/62 |
| 2,422,335 | A | | 6/1947 | Maurice | |
| 2,668,373 | A | | 2/1954 | Russo | |
| 2,718,716 | A | * | 9/1955 | Penney | A43C 15/065 36/61 |
| 2,836,428 | A | | 5/1958 | Hannes | |
| 2,932,096 | A | | 4/1960 | Vincenzo | |
| 3,021,617 | A | | 2/1962 | Koch | |
| 3,095,657 | A | | 7/1963 | Fradette | |
| 3,176,416 | A | | 4/1965 | Seegert | |
| 3,214,850 | A | | 11/1965 | McNair | |
| 3,229,389 | A | | 1/1966 | George | |
| 3,616,552 | A | | 11/1971 | Kniffin et al. | |
| 3,713,233 | A | | 1/1973 | Hunnicutt | |
| 4,005,533 | A | | 2/1977 | Anderson et al. | |
| 4,116,462 | A | | 9/1978 | Buel | |
| 4,299,037 | A | | 11/1981 | Carey | |
| D262,157 | S | * | 12/1981 | Kinchen | D2/962 |
| 4,461,100 | A | | 7/1984 | Minor et al. | |
| 4,772,041 | A | | 9/1988 | Klosterman | |
| D313,111 | S | | 12/1990 | McKinstry | |
| 5,315,768 | A | | 5/1994 | Pacheco | |
| 5,463,823 | A | | 11/1995 | Bell et al. | |
| 5,600,901 | A | | 2/1997 | Leonor | |
| 5,689,901 | A | | 11/1997 | Bell et al. | |
| 5,694,704 | A | | 12/1997 | Kasbrick | |
| 5,813,143 | A | | 9/1998 | Bell et al. | |
| 5,836,090 | A | | 11/1998 | Smith | |
| 5,857,271 | A | | 1/1999 | Pallatin | |
| 5,921,005 | A | | 7/1999 | Bell et al. | |
| 5,926,979 | A | | 7/1999 | Borel | |
| 5,967,531 | A | | 10/1999 | Saillet | |
| 6,099,018 | A | | 8/2000 | Maravetz et al. | |
| 6,154,982 | A | | 12/2000 | Bell et al. | |
| 6,742,286 | B2 | | 6/2004 | Giovale | |
| 6,775,927 | B2 | | 8/2004 | Glicksman | |
| 6,836,977 | B2 | | 1/2005 | Larson et al. | |
| 6,931,769 | B2 | | 8/2005 | Mahoney et al. | |
| 7,089,688 | B2 | | 8/2006 | Giovale | |
| 7,555,850 | B2 | | 7/2009 | Park | |
| 7,686,321 | B2 | | 3/2010 | Cunningham et al. | |
| RE42,965 | E | | 11/2011 | Larson et al. | |
| 8,371,045 | B2 | | 2/2013 | Tambay | |
| RE44,193 | E | | 5/2013 | Larson et al. | |
| 9,161,593 | B2 | | 10/2015 | Larson et al. | |
| D807,005 | S | | 1/2018 | Savio et al. | |
| D831,320 | S | | 10/2018 | Savio et al. | |
| 2003/0052473 | A1 | | 3/2003 | Perkins et al. | |
| 2003/0145489 | A1 | | 8/2003 | Major | |
| 2004/0035024 | A1 | | 2/2004 | Kao | |
| 2004/0045190 | A1 | | 3/2004 | Washburn et al. | |
| 2004/0049943 | A1 | | 3/2004 | Glicksman | |
| 2005/0022430 | A1 | | 2/2005 | Terry | |
| 2005/0198860 | A1 | | 9/2005 | Larson et al. | |
| 2007/0113424 | A1 | | 5/2007 | Bell | |
| 2007/0163148 | A1 | | 7/2007 | Laporte | |
| 2008/0263903 | A1 | | 10/2008 | An | |
| 2009/0049711 | A1 | | 2/2009 | Finch | |
| 2010/0088929 | A1 | | 4/2010 | Comoli | |
| 2011/0047829 | A1 | | 3/2011 | Bell et al. | |

FOREIGN PATENT DOCUMENTS

| | | | |
|---|---|---|---|
| CA | 2555916 | A1 | 9/2005 |
| CA | 2355803 | C | 10/2008 |
| CA | 2555916 | C | 6/2009 |
| CA | 169322 | S | 2/2017 |
| CA | 169323 | S | 2/2017 |
| CA | 2844620 | C | 9/2017 |
| CA | 182847 | S | 9/2019 |
| DE | 102008006267 | B3 | 7/2009 |
| KR | 100983316 | B1 | 9/2010 |

OTHER PUBLICATIONS

"K1 Mid-Sole", SureWerx https://icecleats.surewerx.eom/s/product/a0K3x00000vpXUdEAM/k1-midsole last accessed Apr. 25, 2022, 3 pages.

"Rip Cleats", https://ripscleats.com/ last accessed Apr. 25, 2022, 4 pages.

* cited by examiner

MID-SOLE TRACTION DEVICE

FIELD OF THE DISCLOSURE

The present disclosure is directed to a mid-sole traction device that provides anti-slip protection to footwear such as shoes and boots.

BACKGROUND AND SUMMARY OF THE DISCLOSURE

Traction devices provide protection against slipping on surfaces having a low co-efficient of kinetic friction such as ice, snow and other wet surfaces. It is often dangerous walking, running and working in environments having snow and ice on the surface. Such activities can involve carrying heavy objects where one's vision is at least partially obscured.

Traction devices with spikes exist that attach to footwear. However, such existing traction devices are insufficiently flexible to allow the user to walk or run efficiently and with greater comfort. In addition, this lack of flexibility results in an inefficient contact of the traction spikes to the slippery surface thereby limiting the effectiveness of the traction device. There is therefore a need for a traction device that is flexible, and which permits efficient contact of the bottom surface of the traction device with the ground surface when coupled to a user's footwear.

The present disclosure is directed to a flexible mid-sole traction device which is configured to attach to the mid-sole of an item of footwear such as a shoe or a boot. The mid-sole traction device as attached to the mid-sole of a shoe or a boot has traction elements which are preferably spikes that engage the ground to provide improved traction. The flexibility of the mid-sole traction device and the location of the traction elements on two separate and spaced apart protrusion elements permits the engagement elements to contact and grip the ground efficiently in directing the user's weight transfer.

According to one aspect of the present disclosure, there is provided a mid-sole traction device for attachment to a mid-sole of a shoe or a boot comprising: a traction platform formed of a flexible rubber material, the traction platform having a first face for contacting a ground surface and a second face for attachment to the mid-sole of the shoe or boot, the first face being spaced apart from the second face; a first protrusion formed on the first face, said first protrusion having a first end and a second end, each of the first end and the second end of the first protrusion defining an opening for receiving a spike; a second protrusion formed on the first face, said second protrusion having a first end and a second end, each of the first end and the second end of the second protrusion defining an opening for receiving a spike, the second protrusion being separate from the first protrusion and spaced apart from the first protrusion.

The mid-sole traction device preferably includes a first slot formed in the traction platform and being located near a first peripheral edge of the traction platform for receiving a strap; and a second slot located formed in the traction platform near a second peripheral edge of the traction for receiving a strap.

Additional features and advantages of the present invention will become apparent to those skilled in the art upon consideration of the following detailed description of the illustrative embodiments exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION

The embodiments of the invention described herein are not intended to be exhaustive or to limit the invention to precise forms disclosed. Rather, the embodiments elected for description have been chosen to enable one skilled in the art to practice the invention.

Figure 1:
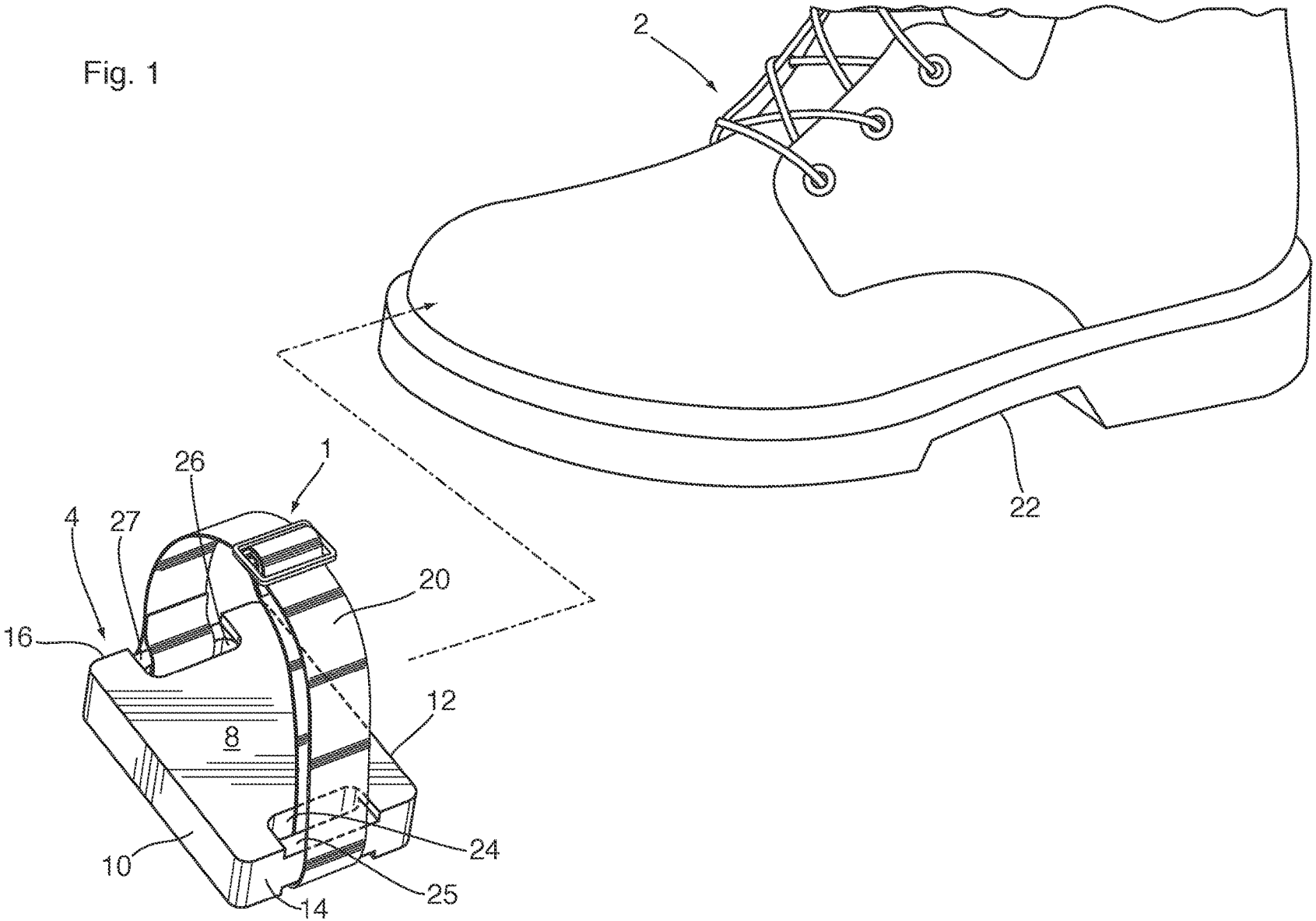
FIG. 1 is a top perspective view of a mid-sole traction device of the present disclosure.
Figure 2:
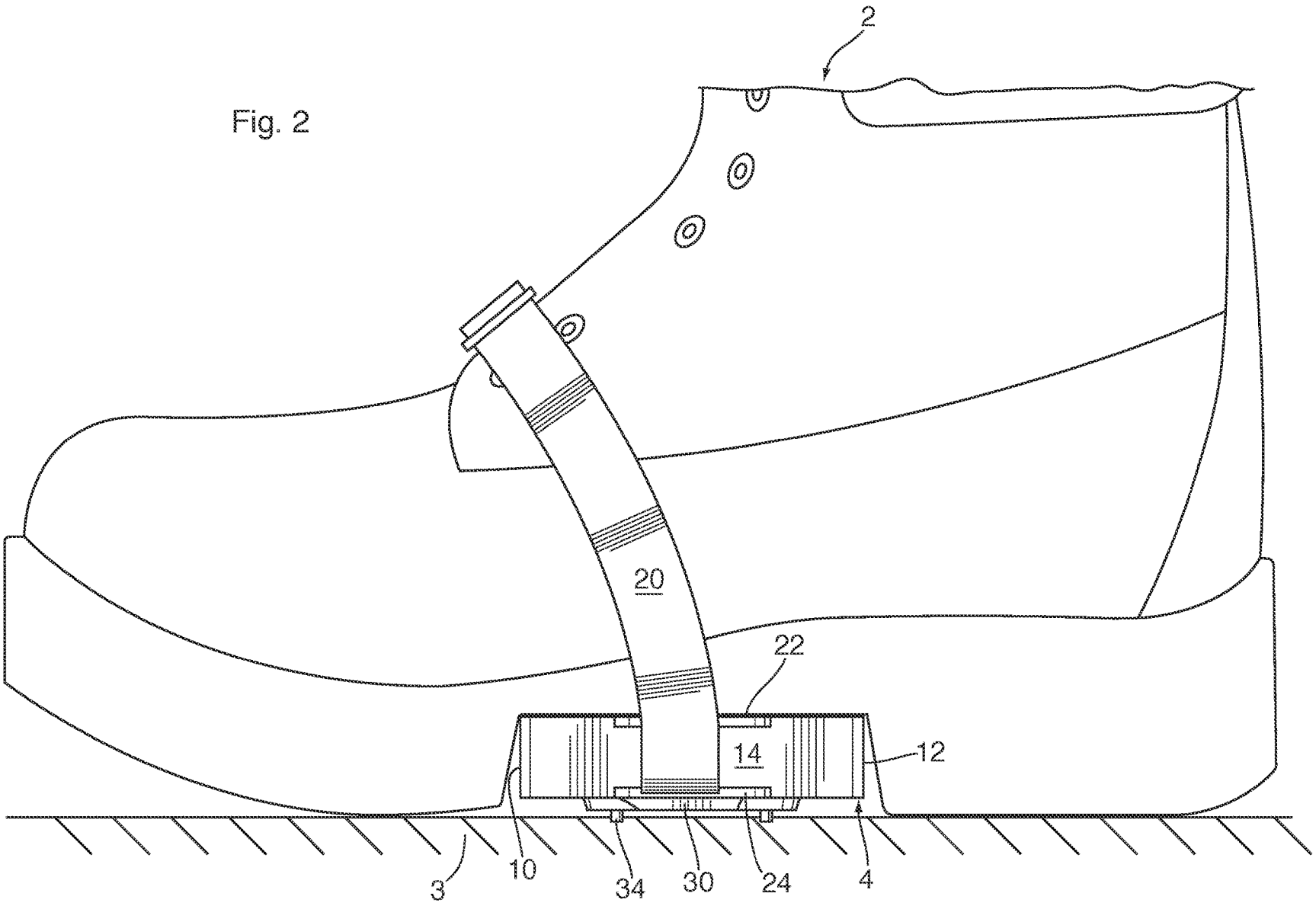
FIG. 2 is a side view of the mid-sole traction device of the present disclosure as attached to a boot.

With reference initially to FIG. 1, an illustrative mid-sole traction device 1 is illustrated with reference to a boot 2 to which the mid-sole traction device 1 is attached at a mid-sole region 22 of the boot 2 as illustrated in FIG. 2.

Figure 5:
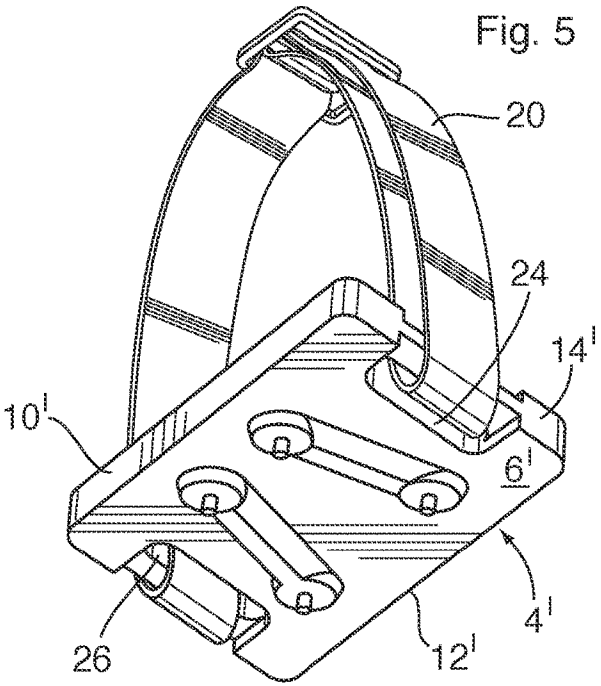
FIG. 5 is a bottom perspective view of an alternate embodiment of the mid-sole traction device of the present disclosure.
Figure 4:
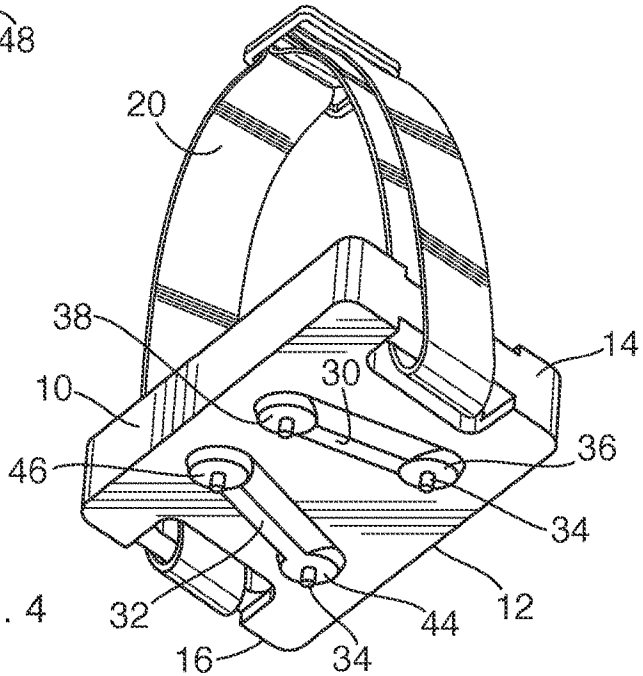
FIG. 4; is a bottom perspective view the mid-sole traction device of the present disclosure.
Figure 3:
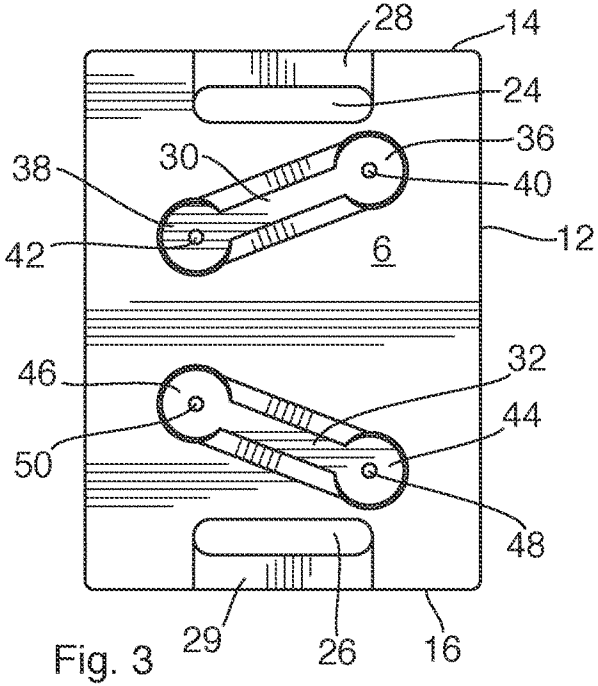
FIG. 3 is a bottom view the mid-sole traction device of the present disclosure.

The mid-sole traction device 1 comprises a traction platform 4 having a first face 6 for contacting a ground surface as shown in FIGS. 3-5, and second face 8 which is attachable to a bottom surface of boot 2 at the mid-sole region 22 as discussed in more detail below. As shown in FIG. 1, the traction platform 4 is preferably rectangular in shape. However, the traction platform 4 is not limited to any particular shape and may have other shapes having different numbers of sides including pentagonal, hexagonal or a square shape. The traction platform 4 may also have a circular or a triangular shape in other embodiments.

The traction platform 4 is constructed of a flexible rubber material. Preferably, the rubber material has the following composition as set out in the table below:

Rubber Composition

| Rubber Composition Component | Content, Wt % |
|---|---|
| Poly(isoprene) | 39 |
| Styrene-butadiene rubber (SBR) | 10 |
| Benzothiazole vulcanizing accelerator | 19 |
| Phenol antioxidant | |
| Quinoline antioxidant | |
| Cyclohexylthiophthalimide | |
| Stearic acid | |
| Mineral oil | |
| Carbon black | 14 |
| Calcium carbonate ($CaCO_3$) | 5 |
| Silicon dioxide ($SiO_2$) | 13 |
| Zinc oxide (ZnO) | |
| Sulfur | |
| Talc | |

The content of the components of the rubber composition was measured by Fourier Transform Infrared Spectrometer.

The hardness of the rubber composition forming the traction platform 4 is 44.5 on the Shore A hardness scale, as measured by a Shore A Durometer apparatus, for the defined heel embodiment of the present disclosure shown in FIGS. 1 to 4. The hardness of the rubber composition forming the traction platform 4' is 45 on the Shore A hardness scale, as measured by a Shore A Durometer apparatus, for the non-defined heel embodiment of the present disclosure shown in FIGS. 5 and 6.

The traction platform 4 has a front surface 10 and a rear surface 12. The thickness of the front surface 10 is equal to the thickness rear surface 12. In the embodiment shown in FIGS. 1-4, the thickness of the front surface 10 and the rear surface 12 is preferably about 15.1 mm. Hence the thickness of the traction platform 4 is preferably about 15.1 mm.

The traction platform 4 preferably defines a first slot 24 and a second slot 26 formed through the traction platform 4. The first slot 24 is formed near a first side surface 14. The second slot 26 is formed near a second side surface 16. The first slot 24 and the second slot 26 are both integrally formed on traction platform 4 without the inclusion of any additional supporting members such as rods.

The first side surface 14 corresponds in size and in shape to the second side surface 16. A first slot outer second surface 25 is formed on an outer portion of the first slot 24 between the slot 24 and a periphery of first side surface 14. The first slot outer second surface 25 extends along a length of the first slot 24 on the second face 8 and is recessed with respect to the second face 8. The portions of first side surface 14 that are not continuous with the first slot outer second surface 25 have the same thickness as the front surface 10 and the rear surface 12. Similarly, a second slot outer second surface 27 is formed on an outer portion of the second slot 26 along the second face 8 between the second slot 26 and a periphery of second side surface 16. The second slot outer second surface 27 extends along a length of the second slot 26 along the second face 8 and is recessed with respect to the second face 8. The portions of second side surface 16 that are not continuous with the second slot outer second surface 27 have the same thickness as the front surface 10 and the rear surface 12. A thickness of the first side surface 14 and the second side surface 16 is about 15 mm. A thickness of the first side surface 14 and the second side surface 16 adjacent the first slot 24 and the second slot respectively is less creating a recessed surface adjacent to the slots. In an alternate embodiment, as shown in FIG. 5, the thickness of the first side surface 14 and the second side surface 16 is about 7.5 mm and the thickness adjacent to the slots is also reduced creating a recessed surface adjacent to the slots.

As best shown in FIGS. 2 and 4, a strap 20 is received through the first slot 24 and the second slot 26. The strap is preferably constructed of an elastomeric material which can include rubbers, reinforced rubbers, polymeric material and other suitable materials. The strap has an elasticity sufficient to maintain tension when the traction platform is positioned on the mid-sole of a boot as shown in FIG. 2.

With reference to FIG. 3, the traction platform 4 has a first face 6. A first slot outer first surface 28 is formed on an outer portion of the first slot 24 between the slot 24 and a periphery of first side surface 14. The first slot outer first surface 28 extends along a length of the first slot 24 on the first face 6 and is recessed with respect to the first face 6. Similarly, a second slot outer first surface 29 is formed on an outer portion of the second slot 26 along the first face 6 between the second slot 26 and a periphery of second side surface 16. The second slot outer first surface 29 extends along a length of the second slot 26 along the first face 6 and is recessed with respect to the first face 6.

In alternate embodiments, it is possible to construct the mid-sole traction device 1 without slots and to attach the mid-sole traction device 1 to the bottom of a shoe or a boot using an adhesive or other attachment means.

A first protrusion 30 is formed on the first face 6. The first protrusion 30 is preferably linear having a first end 36 and a second end 38. The first end 36 and the second end 38 are preferably circular in shape and preferably have a diameter that is greater than a width of the linear portion of the protrusion 30. An opening 40 is formed in the first end 36 for receiving traction element preferably in the form of a spike. Similarly, an opening 42 is formed in the second end 38 for receiving traction element preferably in the form of a spike.

A second protrusion 32 is formed on the first face 6. The second protrusion 32 is preferably linear having first end 44 and a second end 46. The first end 44 and the second end 46 are preferably circular in shape and preferably have a diameter that is greater than a width of the linear portion of the protrusion 32. An opening 48 is formed in the first end 44 for receiving traction element preferably in the form of a spike. Similarly, an opening 50 is formed in the second end 46 for receiving traction element preferably in the form of a spike.

The first protrusion 30 is spaced apart from the second protrusion 32 on the first face 6 such that there are no protruding elements between the first protrusion 30 and the second protrusion 32 in order to impart flexibility to the traction platform 4. The first protrusion 30 and the second protrusion 32 are preferably in a diagonal orientation on the first face 6. Preferably, the first protrusion 30 is opposite in diagonal orientation relative the second protrusion 32 such that a distance between the first end 36 of the first protrusion 30 and the first end 44 of the second protrusion 48 is greater than a distance between the second end 38 of the first protrusion 30 and the second end 46 of the second protrusion 32.

Spikes 34 are received in the openings 40, 42, 48, 50 of the first protrusion 30 and the second protrusion 32 respectively. The spikes 34 are preferably comprised of 15% by weight of cobalt, 75% by weight of tungsten and 10% by weight of carbon.

Figure 6:
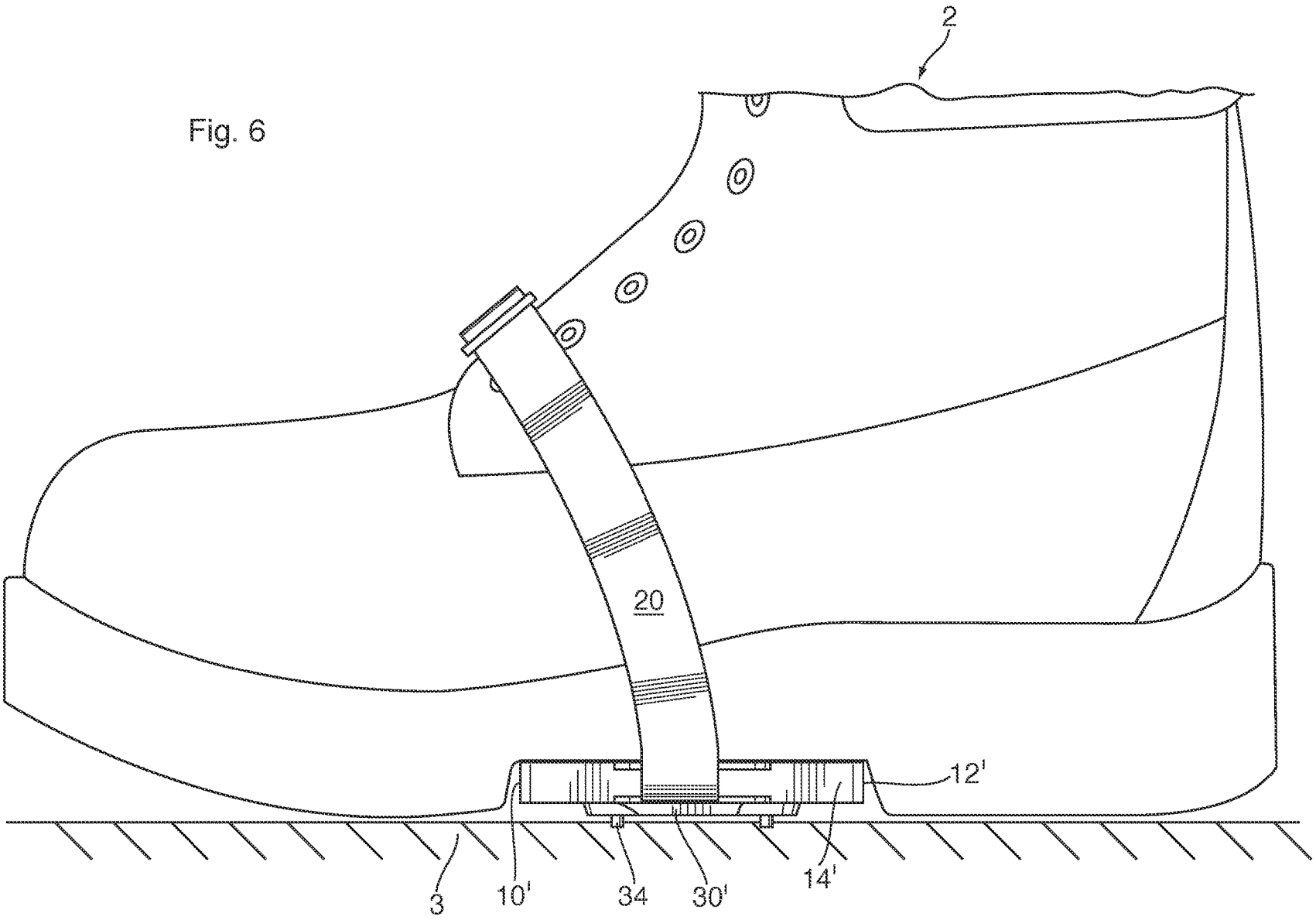
FIG. 6 is a side view of the alternate embodiment of the mid-sole traction device of the present disclosure as attached to a boot.

The preferred embodiment of the present disclosure is applied to footwear having a defined heel. An alternate embodiment of the present disclosure is shown in FIGS. 5 and 6 which is applied to footwear having a non-defined heel. The traction platform 4' of the alternate embodiment, is thinner than in the preferred embodiment. In particular, the thickness of the traction platform 4' of the alternate embodiment is preferably about 7.5 mm. As the such the front surface 10' and the rear surface 12' of the alternate embodiment are preferably about 7.5 mm in thickness. The alternate embodiment has the same features as the preferred embodiment other than the different thickness of the traction platform 4'. In particular, the slots of the alternate embodiment also have an outer surface that is recessed relative to the traction platform 4'.

The mid-sole traction device is constructed according to methods known in the art such as injection molding involving the injection of a hot polymeric material into a cold mold. Preferably, the heel traction device is constructed using compression molding machines.

The raw material is weighed and cut to size to fit into the mold. The temperature is carefully monitored to be consistent with the cycle time required to flow the material to all portions of the mold. Once the cycle is complete, the operator uses compressed air to cleanly lift the molded part out of the tooling by hand.

Injection molding techniques that extrude material over an existing core plate in the mold to provide a unitary construction may also be employed.

In operation, the mid-sole traction device 1 is attached to footwear such as a boot 2 at the mid-sole 22 as shown in FIG. 2. The flexibility of the traction platform 4 given the overall construction of the mid-sole traction device 1 provides sufficient flexibility that the first face 6 makes direct contact with a ground surface 3 so that the spikes 34 engage the ground directly with maximum contact force in order to provide an effective grip to minimize the risk of the user slipping and falling.

Although the invention has been described in detail with reference to certain preferred embodiments, variations and modifications exist within the spirit and scope of the invention as described and defined in the following claims.

The invention claimed is:

1. A mid-sole traction device for attachment to a mid-sole of a shoe or a boot, the mid-sole traction device comprising:

a traction platform formed of a flexible rubber material, the traction platform having a first face for contacting a ground surface and a second face for attachment to the mid-sole of the shoe or boot, the first face being spaced apart from the second face;

a first protrusion formed on the first face, said first protrusion having a first end and a second end, each of the first end and the second end of the first protrusion defining an opening for receiving a spike; and a second protrusion formed on the first face, said second protrusion having a first end and a second end, each of the first end and the second end of the second protrusion defining an opening for receiving a spike, the second protrusion being separate from the first protrusion and spaced apart from the first protrusion.

2. The mid-sole traction device of claim 1, further comprising:

a first slot formed in the traction platform and being located near a first peripheral edge of the traction platform for receiving a strap; and a second slot located formed in the traction platform near a second peripheral edge of the traction for receiving the strap.

3. The mid-sole traction device of claim 2, further comprising an elastomeric strap received in the first and second slots.

4. The mid-sole traction device of claim 2 wherein the first slot and the second slot are integrally formed in the traction platform.

5. The mid-sole traction device of claim 1 wherein the first protrusion is linear.

6. The mid-sole traction device of claim 5 wherein the second protrusion is linear.

7. The mid-sole traction device of claim 6 wherein the first protrusion and the second protrusion are diagonal in orientation on the first face.

8. The mid-sole traction device of claim 7 wherein the first protrusion is opposite in diagonal in orientation relative the second protrusion such that a distance between the first end of the first protrusion and the first end of the second protrusion is greater than a distance between the second end of the first protrusion and the second end of the second protrusion.

9. The mid-sole traction device of claim 1, further comprising spikes received in the openings of the first end and the second end of the first protrusion and in the openings of the first end and the second end of the second protrusion.

10. The mid-sole traction device of claim 1 wherein the spikes include 15% by weight of cobalt, 75% by weight of tungsten, and 10% by weight of carbon.

11. The mid-sole traction device of claim 1 wherein the traction platform includes a rubber composition comprising of about 39% by weight of polyisoprene, and about 10% by weight of styrene-butadiene rubber (SBR).

12. The mid-sole traction device of claim 11 wherein the rubber composition includes about 14% by weight of carbon black and about 5% by weight of calcium carbonate.

13. The mid-sole traction device of claim 11 wherein the rubber composition further includes benzothiazole vulcanizing accelerator, phenol antioxidant, quinoline antioxidant, cyclohexylthiophthalimide, stearic acid and mineral oil, wherein the combination of the benzothiazole vulcanizing accelerator, phenol antioxidant, quinoline antioxidant, cyclohexylthiophthalimide, stearic acid and mineral oil constitutes about 19% by weight of the rubber composition.

14. The mid-sole traction device of claim 11 wherein the rubber composition further includes silicon dioxide, zinc oxide, sulfur and talc, wherein the combination of the silicon dioxide, zinc oxide, sulfur and talc constitutes about 13% by weight of the rubber composition.

15. The mid-sole traction device of claim 11 wherein the rubber composition has hardness of 44.5 or 45 on the Shore A hardness scale.

16. The mid-sole traction device of claim 1 wherein a thickness of the traction platform is about 15 mm.

17. The mid-sole traction device of claim 1 wherein a thickness of the traction platform is about 7.5 mm.

18. The mid-sole traction device of claim 1 wherein the first and second ends of the first and second protrusions are circular and have a diameter greater than the width of respective linear portions of the protrusions connecting the first and second ends.

19. The mid-sole traction device of claim 1 wherein the traction platform includes a rubber composition having a hardness of about 44.5 on the Shore A hardness scale.

20. The mid-sole traction device of claim 1 wherein the traction platform includes a rubber composition having a hardness of about 45 on the Shore A hardness scale.

* * * * *